United States Patent [19]

Morris

[11] 4,009,809

[45] Mar. 1, 1977

[54] BACK-PACK FRAME

[75] Inventor: Lowell H. Morris, Dixon, Calif.

[73] Assignee: Morris Manufacturing Company, Dixon, Calif.

[22] Filed: May 5, 1975

[21] Appl. No.: 574,358

[52] U.S. Cl. ..... 224/25 A; 211/189

[51] Int. Cl.[2] ..... A45F 3/10

[58] Field of Search ..... 224/25 A, 8 R, 25 R, 224/5 R, 8 A, 9, 10; 211/85, 118, 148, 177, 182

[56] References Cited

UNITED STATES PATENTS

| | | | |
|---|---|---|---|
| 3,563,431 | 2/1971 | Pletz | 224/25 A |
| 3,827,612 | 8/1974 | Mead et al. | 224/25 A |
| 3,897,894 | 8/1975 | Lawrence | 224/25 A |

*Primary Examiner*—Robert J. Spar
*Assistant Examiner*—Jerold M. Forsberg
*Attorney, Agent, or Firm*—Roger B. Webster

[57] ABSTRACT

A back-pack frame, formed of lightweight metallic tubing, comprising a pair of substantially U-shaped members disposed in end-to-end facing relation with the outer end portions of the legs of one member telescopically engaged in the outer end portions of the legs of the other member; there being intermediate cross bars spanning in engaged relation between, and supported by, the legs of said U-shaped members, and said cross bars having tongues projecting from their ends and extending into slots in the corresponding legs.

1 Claim, 8 Drawing Figures

BACK-PACK FRAME

BACKGROUND OF THE INVENTION

In the manufacture of back-pack frames from lightweight metallic tubing, difficulties have been encountered in efforts to provide a simplified structure which is easy to manufacture yet producing a back-pack frame having the substantial inherent rigidity necessary for proper and effective use. The present back-pack frame was conceived by me in a successful effort to overcome such difficulties.

SUMMARY OF THE INVENTION

The present invention provides, as a major object, a back-pack frame, formed of lightweight metallic tubing, which comprises an upper, downwardly facing, one-piece, substantially U-shaped member, a lower, upwardly facing, one-piece, substantially U-shaped member, said members each including transversely spaced, tubular legs with corresponding legs telescopically engaged at adjacent end portions, and intermediate cross bars spanning in engaged relation between, and supported by, the legs of said members; the cross bars having tongues projecting from their ends, and the legs having corresponding slots into which the tongues extend. As so assembled, the U-shaped members, and the includes cross bars, provide a rigid, unitary back-pack frame.

The present invention provides, as another important object, a back-pack frame, as in the preceding paragraph, in which the legs of the U-shaped members initially slightly converge, are sprung apart to permit insertion of the cross bar tongues into the leg slots, and are then permitted to spring back to fully engage the tongue in said slots, and at which time the cross bars—by reason of the predetermined length thereof—end-abut the legs of the respective U-shaped members and space such legs in parallel relation preparatory to said telescopic engagement thereof.

The present invention provides, as a further object, a back-pack frame which is designed for ease and economy of manufacture.

The present invention provides, as a still further object, a practical, reliable, and durable back-pack frame, and one which is exceedingly effective for the purpose of which it is designed.

DESCRIPTION OF THE PREFERRED EMBODIMENT

Figure 3:
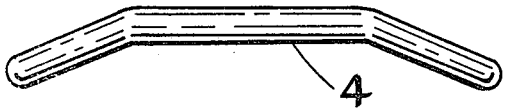
FIGS. 3 and 4 are upper and lower end views, respectively, of the same.
Figure 1:
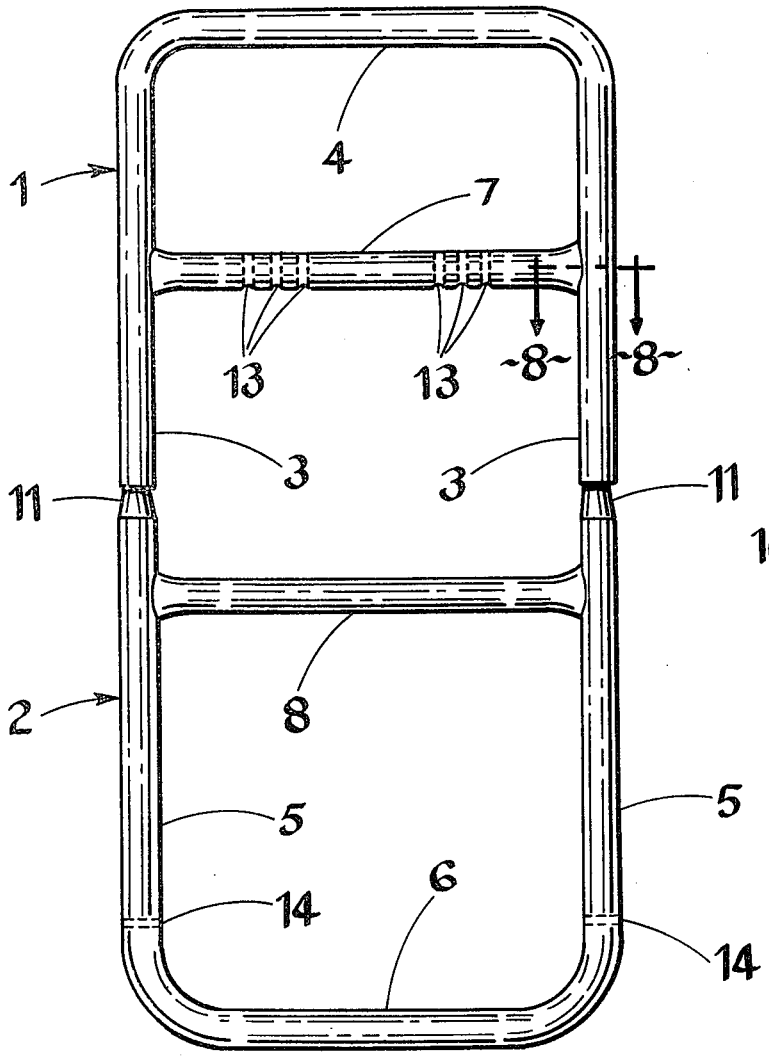
FIG. 1 is a front elevation of the back-pack frame as fully assembled.
Figure 2:
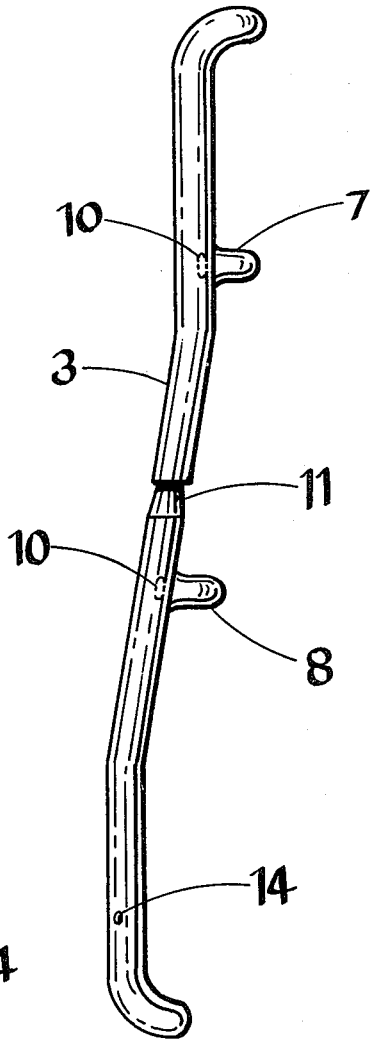
FIG. 2 is a side elevation of such assembled back-pack frame.
Figure 4:
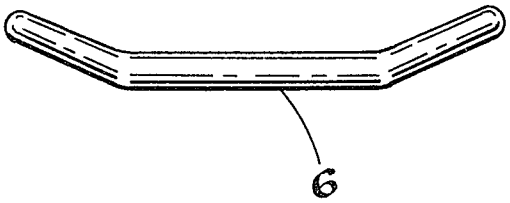

Referring now more particularly to the drawings and to the characters of reference marked thereon, the back-pack frame comprises, of lightweight metallic tubing, an upper, downwardly facing, one-piece, substantially U-shaped member 1, and a lower, upwardly facing, one-piece, substantially U-shaped member 2; the upper U-shaped member 1 including legs 3 connected by a transverse top bar 4, while the lower U-shaped member 2 includes legs 5 connected by a transverse bottom bar 6.

A cross bar 7 spans between, and is supported by, the legs 3 of the U-shaped member 1, and a cross bar 8 spans between, and is supported by, the legs 5 of U-shaped member 2. Each such cross bar (7 or 8)—which is initially separate and installed as hereinafter appears—is formed at each end with an integral projecting tongue 9 which extends into a slot 10 in the related leg (3 or 5).

Figure 8:
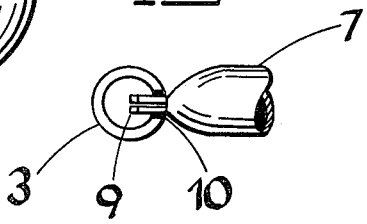
FIG. 8 is a cross section taken substantially on line 8—8 of FIG. 1.

As the several tongue and slot arrangements are alike—except for being right or left hand adaptations—a showing thereof (as in FIGS. 5 and 8) is deemed sufficient for all.

The upper end portions 11 of the legs 5 of U-shaped member 2 are swedged to a reduced outside diameter and telescoped into legs 3 from the lower end of the latter, whereby the U-shaped members 1 and 2 are effectively connected in rigid unitary relation. Accidental axial separation of the telescoped leg portions 11 is prevented by suitable means such as screws 12 which connect transversely between the same.

Figure 5:
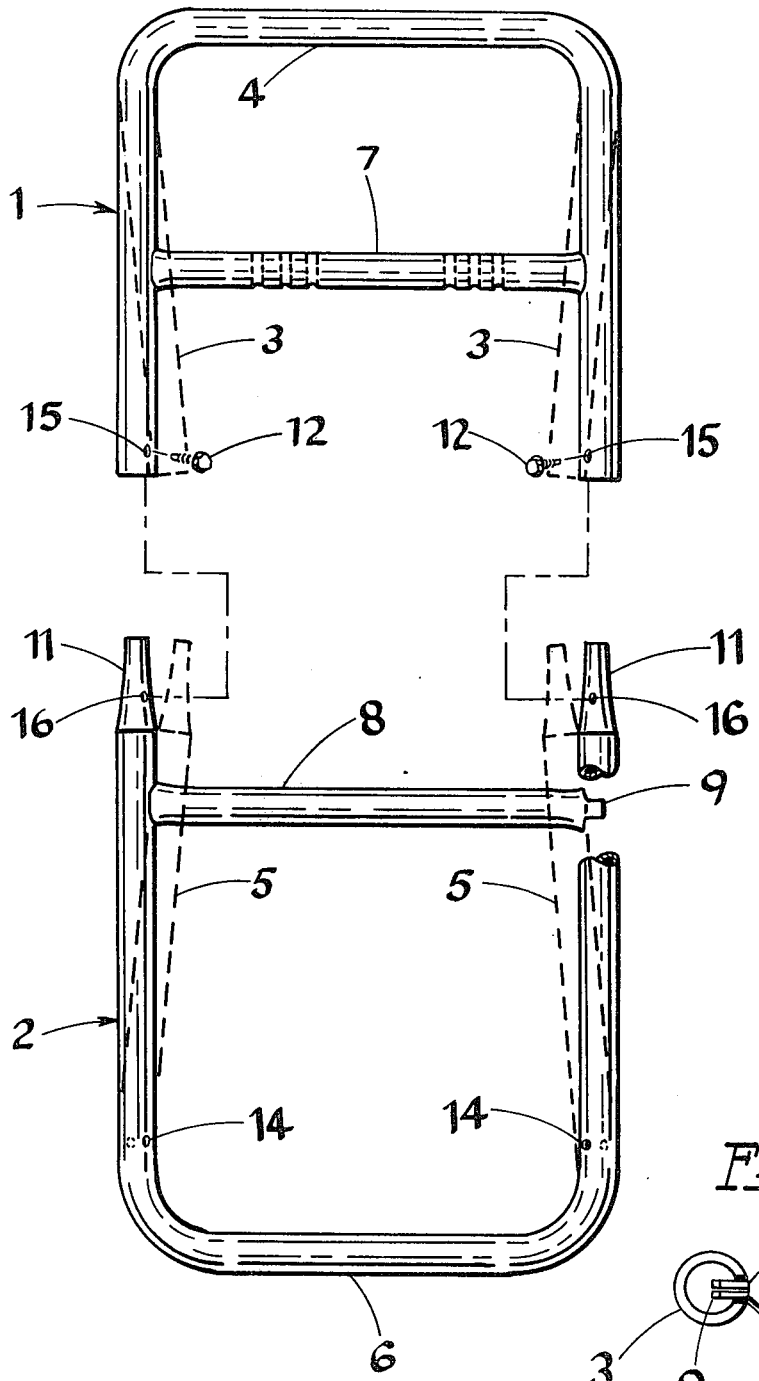
FIG. 5 is an exploded rear elevation of the back-pack frame partially broken away, and with the initial convergence of the legs of the individual members shown in broken lines.
Figure 6:
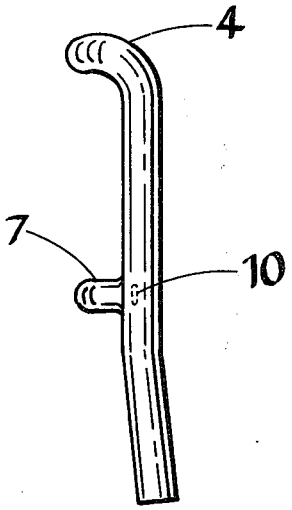
FIG. 6 is a side elevation of the upper member, detached.
Figure 7:
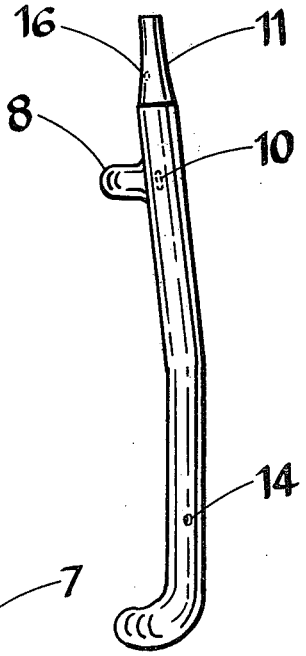
FIG. 7 is a side elevation of the lower member, detached.

The manner of assembly of each initially separate cross bar (7 or 8) with the corresponding U-shaped member (1 or 2) is as follows:

By reference, for example, to U-shaped member 1 and its cross bar 7, such member 1 is initially formed with the legs 3 converging slightly toward their outer ends as shown in broken lines in FIG. 5; such legs intermediate their ends, then being spaced apart transversely a distance less than the length—between the tongues 9—of the cross bar 7. To assemble said cross bar 7 in U-shaped member 1, said initially converging legs 3 are sprung apart sufficiently to permit the tongues 9 of cross bar 7 to extend into the related slots 10 of said legs 3. Nextly, the legs 3 are permitted to spring back until the tongues fully seat in the slots, and at which time the cross bar 7—by reason of its predetermined length—end-abuts the legs and holds them spaced in parallel. Cross bar 8 is assembled in the U-shaped member 2 in the same fashion; said member 2 likewise having its legs 5 in initially slightly converging relation.

With the legs of each of the U-shaped members thus held in parallel by the cross bars as assembled therewith, the aforesaid telescopic engagement of the legs of the members 1 and 2 is readily accomplished.

Upon such telescopic engagement of the legs of the U-shaped members 1 and 2, the legs of each member cannot accidentally spread apart, and hence—without more than the tongue and slot arrangements—the cross bars 7 and 8 are effectively and fixedly secured in place in the U-shaped members 1 and 2.

While the back-pack frame is here shown with only a single cross bar spanning between the legs of each U-shaped member, two or more cross bars may be employed if desired.

The top bar 4, bottom bar 6, and cross bars 7 and 8 are each bowed rearwardly, as shown, to provide comfortable engagement of the back-pack frame with the body of the user, while an intermediate portion of the assembled frame inclines slightly forward for a like purpose; such features being substantially conventional contours in back-pack frames.

In order to permit the attachment of lacings or tie cords to the back-pack frame, the same is provided with holes 13 in cross bar 7, holes 14 in legs 5, and elsewhere if desired.

From the foregoing description, it will be readily seen that there has been produced such a back-pack frame as substantially fulfills the objects of the invention, as set forth herein.

While this specification sets forth in detail the present and preferred construction of the back-pack frame, still in practice such deviations from such detail may be resorted to as do not form a departure from the spirit of the invention as defined by the appended claims.

I claim:

1. In a back-pack frame comprising a pair of initially separate, one-piece, substantially U-shaped members formed of tubing, said members being disposed in end-to-end facing relation, the outer end portions of the tubular legs of one member being of reduced outside diameter and telescopically engaged in the outer end portions of the tubular legs of the other member, elements connecting said telescoped leg portions, and cross bars spanning in engaged relation between and supported by the legs of said members, the cross bars having tongues projecting from their ends, the legs having corresponding slots into which the tongues extend, the cross bars end-abutting the legs when the tongues extend into said corresponding slots, and the cross bars being of a length between the tongues to space the related legs in parallel; the characteristic improvement comprised of of the legs of the individual members initially coonverging sightly toward the outer ends thereof, said intially converging legs of the members first being spread apart beyond parallel to permit primary insertion of the tongues of the cross bars into the corresponding slots in the legs, and then said legs are permitted to spring back, as limited by the cross bars, to said parallel position whence the tongues fully seat in the slots, the outer end portions of the legs of said members then being telescopically engaged and connected by said elements.

* * * * *